US011939135B2

(12) United States Patent
Kilmer et al.

(10) Patent No.: US 11,939,135 B2
(45) Date of Patent: Mar. 26, 2024

(54) COMPARTMENTALIZED SHIPPING CONTAINER FOR TEMPERATURE CONTROL MATERIAL DISTRIBUTION

(71) Applicant: American Aerogel Corporation, Rochester, NY (US)

(72) Inventors: Derek S. Kilmer, Pittsford, NY (US); Jeffrey R. Sullivan, Rochester, NY (US); Alan J. Krokenberger, Rochester, NY (US); Jason R. Rudgers, Rochester, NY (US)

(73) Assignee: American Aerogel Corporation, Rochester, NY (US)

( * ) Notice: Subject to any disclaimer, the term of this patent is extended or adjusted under 35 U.S.C. 154(b) by 0 days.

(21) Appl. No.: 16/756,387

(22) PCT Filed: Oct. 15, 2018

(86) PCT No.: PCT/US2018/055889

§ 371 (c)(1),
(2) Date: Apr. 15, 2020

(87) PCT Pub. No.: WO2019/079186

PCT Pub. Date: Apr. 25, 2019

(65) Prior Publication Data

US 2021/0188517 A1 Jun. 24, 2021

Related U.S. Application Data

(60) Provisional application No. 62/573,136, filed on Oct. 16, 2017.

(51) Int. Cl.
*B65D 81/18* (2006.01)
*B65B 5/04* (2006.01)
(Continued)

(52) U.S. Cl.
CPC ..... *B65D 81/18* (2013.01); *B65B 5/04* (2013.01); *B65B 7/28* (2013.01); *B65D 25/08* (2013.01);
(Continued)

(58) Field of Classification Search
CPC ..... B65D 81/3862; B65D 81/3816; B65D 81/3858; B65D 81/3834; B65D 5/0254;
(Continued)

(56) References Cited

U.S. PATENT DOCUMENTS 1,707,836 A 4/1929 Wright
1,822,850 A 9/1931 Killeffer
(Continued)

FOREIGN PATENT DOCUMENTS

CN 205602414 9/2016
EP 2883811 6/2015
(Continued)

OTHER PUBLICATIONS

Extended European Search Report dated Jul. 22, 2021 in EP Patent Application No. 18867940.1, pp. 1-10.
(Continued)

*Primary Examiner* — Andrew T Kirsch
(74) *Attorney, Agent, or Firm* — Byrne Poh LLP; Nina R. Horan

(57) ABSTRACT

An insulated shipping container is provided for maintaining a substantially uniform internal temperature. The base, walls and lid of an outer box define an enclosure. An insulating body and an insulating cover are located within the enclosure and define an insulated cavity. A chamber having a plurality of chamber sides is configured to hold one or more payloads at the substantially uniform internal temperature. A temperature control material distribution structure is located within the insulated cavity for constraining motion of tem-
(Continued)

perature control material units. The temperature control material distribution structure comprises at least one partitioned tray or trough. The at least one partitioned tray comprises a tray bottom; and a plurality of partition walls extending away from the tray bottom and defining a plurality of partition compartments.

23 Claims, 14 Drawing Sheets

(51) Int. Cl.

| | |
|---|---|
| ***B65B 7/28*** | (2006.01) |
| ***B65D 25/08*** | (2006.01) |
| ***B65D 81/38*** | (2006.01) |
| ***F25D 3/06*** | (2006.01) |
| ***F25D 3/12*** | (2006.01) |

(52) U.S. Cl.
CPC ..... *B65D 81/3853* (2013.01); *B65D 81/3858* (2013.01); *B65D 81/3862* (2013.01); *F25D 3/06* (2013.01); *F25D 3/125* (2013.01); *F25D 2331/804* (2013.01)

(58) Field of Classification Search
CPC .... B65D 5/0227; B65D 5/508; B65D 5/5083; B65D 5/4608; B65D 25/08; F25D 3/06
See application file for complete search history.

(56) References Cited

U.S. PATENT DOCUMENTS

| | | | | |
|---|---|---|---|---|
| 2,632,311 | A | 3/1953 | Sullivan | |
| 4,145,895 | A * | 3/1979 | Hjertstrand | F25D 3/00 165/47 |
| 5,042,260 | A | 8/1991 | George, Sr. | |
| 5,501,338 | A | 3/1996 | Preston | |
| 5,669,233 | A | 9/1997 | Cook et al. | |
| 6,237,535 | B1 | 5/2001 | LaRosa | |
| 6,666,032 | B1 | 12/2003 | Rickson et al. | |
| 6,910,582 | B2 | 6/2005 | Lantz | |
| 8,250,882 | B2 | 8/2012 | Mustafa et al. | |
| 8,763,811 | B2 | 7/2014 | Lantz | |
| 9,010,536 | B2 * | 4/2015 | McCanless | B65D 21/0233 220/608 |
| 9,371,169 | B1 | 6/2016 | Petrucci et al. | |
| 2005/0224501 | A1 | 10/2005 | Folkert et al. | |
| 2006/0230778 | A1 | 10/2006 | Williams | |
| 2007/0193298 | A1 | 8/2007 | Derifield | |
| 2008/0135564 | A1 | 6/2008 | Romero | |
| 2009/0193765 | A1 | 8/2009 | Lantz | |
| 2013/0213977 | A1 | 8/2013 | Stathes et al. | |
| 2014/0138392 | A1 | 5/2014 | McCormick | |
| 2015/0192340 | A1 * | 7/2015 | Andrews | F25D 3/08 220/23.83 |
| 2016/0362240 | A1 | 12/2016 | Ferracamo, Jr. | |
| 2017/0043937 | A1 | 2/2017 | Lantz | |
| 2017/0066582 | A1 | 3/2017 | Vogel et al. | |
| 2021/0188522 | A1 | 6/2021 | Kilmer et al. | |

FOREIGN PATENT DOCUMENTS

| | | |
|---|---|---|
| GB | 2543047 | 4/2017 |
| WO | WO 2014125878 | 8/2014 |
| WO | WO 2017062692 | 4/2017 |

OTHER PUBLICATIONS

International Search Report and Written Opinion dated Dec. 31, 2018 in International Patent Application No. PCT/US2018/055889.
International Preliminary Report on Patentability dated Apr. 30, 2020 in International Patent Application No. PCT/US2018/055889.
Office Action dated Apr. 23, 2021 in U.S. Appl. No. 17/191,094, pp. 2-11.
Office Action dated Aug. 12, 2021 in U.S. Appl. No. 17/191,094, pp. 2-16.
Office Action dated Dec. 16, 2021 in U.S. Appl. No. 17/191,094, pp. 2-17.
Advisory Action dated Apr. 7, 2022 in U.S. Appl. No. 17/191,094, pp. 1-7.
Notice of Allowance dated May 27, 2022 in U.S. Appl. No. 17/191,094, pp. 2-5.
Examination Report dated Dec. 8, 2023 in EP Patent Application No. 18867940.1, pp. 1-6.

* cited by examiner

COMPARTMENTALIZED SHIPPING CONTAINER FOR TEMPERATURE CONTROL MATERIAL DISTRIBUTION

1. BACKGROUND OF THE INVENTION

For temperature control within a shipping container, it can be advantageous to use a temperature control material to keep the payload (i.e., the item to be shipped) at a temperature below ambient temperature. Typically pellets of dry ice are loosely loaded into the space next to the payload, and contact between the payload and the dry ice is maintained through gravity. However, during transportation, the shipping container can be placed in a variety of orientations, which can cause the dry ice to move within the shipping container. Furthermore, at atmospheric pressure, dry ice sublimes into carbon dioxide gas at −78.5° C. As the dry ice pellets sublime, the volume of the pellets within the shipping container is reduced. As a result of dry ice moving, and its reduced volume, the area of contact between the dry ice and the payload decreases. Part, or all of the payload, that is no longer in contact with dry ice can warm, leading to an overall increase in temperature of the payload or the occurrence of undesirable warm spots. The increased temperature may cause the payload to degrade.

US Patent Application Publication No. 2009/0193765 discloses an expansible volume-varying insulator that can expand in thickness so that a coolant is held in good heat transfer contact with the payload. As shown in FIG. 1A-FIG. 1C (which corresponds to FIGS. 4-6 of US 2009/0193765), shipping container 10 includes an exterior cardboard box 12. Expansible volume-varying insulating panels 20*a*/20*b* are placed in a compressed state next to the walls of the box 12 and provide an interior cavity. The payload 36 is placed within the cavity and dry ice pellets 38 are placed around the payload 36. FIG. 1A shows a cross-sectional view of shipping container 10 a short time after the dry ice 38 is loaded and the shipping container 10 is closed. The volume-varying insulating panels 20*a*/20*b* expand in thickness enough to be conformal to the mass of dry ice pellets 38 such that the pellets 38 are urged into snug engagement with the payload 36, thereby ensuring good heat transfer between the dry ice pellets 38 and the payload 36. As shown in FIG. 1B, over time, the dry ice pellets 38 sublime and decrease in volume. The volume-varying insulating panels 20*a*/20*b* expand in thickness sufficiently that the remaining volume of dry ice pellets 38 is still snugly urged against the payload 36. FIG. 1C shows a later time when the dry ice 38 has decreased in volume so that only a small fraction of its original volume remains. The volume-varying insulating panels 20*a*/20*b* expand in thickness even more, and sufficiently so that the small remaining volume of dry ice pellets 38 is still held against the payload 36.

A disadvantage to the expansible volume-varying insulator disclosed in US Patent Application Publication No. 2009/0193765 is that thermal insulation becomes less effective when it is compressed. When a thermal insulator is compressed by more than about 10% in thickness (i.e., its compressed thickness is less than 90% of its uncompressed thickness), its insulation value (i.e., its R rating) is adversely affected. See U.S. Pat. No. 8,763,811. For the expansible volume-varying insulator disclosed in US Patent Application Publication No. 2009/0193765 to continue to function as the dry ice sublimes, the initial compressed thickness of the volume-varying insulating panels 20*a*/20*b* (FIG. 1A) must be less than half of their somewhat uncompressed thickness (FIG. 1C). The poor insulation value of the initially compressed volume-varying insulation panels 20*a*/20*b* will result in comparatively rapid sublimation of the outermost dry ice pellets 38 that are closest to the walls of the box 12. Although extra amounts of dry ice pellets 38 can be added during packing to compensate, this increases shipping weight and cost.

Accordingly, there is a need to develop a shipping container that maintains a payload at a substantially uniform temperature for an extended duration of time, regardless of the orientations that the shipping container may experience during shipping. There is also a need to develop a shipping container that constrains the motion of the temperature control material within the shipping container.

Citation of any reference in Section 1 of this application is not to be construed as an admission that such reference is prior art to the present application.

2. SUMMARY OF THE DISCLOSURE

The present disclosure provides an insulated shipping container for maintaining a substantially uniform internal temperature. The insulated shipping container includes an outer box having a base upon which the insulated shipping container sits when the insulated shipping container is in a standard orientation, at least one wall that is connected to the base and that extends away from the base, and a lid having an open position and a closed position, such that the base, the at least one wall and the lid define an enclosure within the outer box when the lid is in its closed position. An insulating body having a first portion located near the base and a second portion located near the at least one wall is disposed within the enclosure and proximate to the outer box. An insulating cover having an open position and a closed position is located near the lid when the lid is in its closed position. The insulating body and the insulating cover define an insulated cavity when the insulating cover is closed onto the insulating body. A chamber having a plurality of chamber sides is configured to hold one or more payloads at the substantially uniform internal temperature. A temperature control material distribution structure comprising one or more temperature control material units is disposed within the insulated cavity and constrains motion of temperature control material units. The temperature control material distribution structure comprises at least one two-dimensional array of compartments located proximate to a corresponding one of the plurality of chamber sides.

In other embodiment, the disclosure provides a method of packing an insulated shipping container for maintaining one or more payloads at a substantially uniform internal temperature. The method comprises providing an outer box having a base, a plurality of walls that extend away from the base, a lid and an insulating body surrounded by the base and the plurality of walls. The outer box is oriented to sit on its base and the lid is opened. Temperature control material units are dispensed in distributed fashion into compartments of at least one two-dimensional array of compartments in the insulating body. A payload is inserted into a chamber within the insulating body, such that the chamber is at least partially surrounded by the at least one two-dimensional array of compartments. An insulating cover is placed over the insulating body and the lid of the outer box is closed.

The shipping containers of the disclosure advantageously provide a substantially uniform temperature across the chamber, thus maintaining the payload within a predetermined acceptable temperature range for an extended period of time. In addition, the shipping containers of the disclosure provide the predetermined acceptable temperature range regardless of the orientation of the shipping container.

3. BRIEF DESCRIPTION OF THE DRAWINGS

It is to be understood that the attached drawings are for purposes of illustrating the concepts of the invention and may not be to scale. Identical reference numerals have been used, where possible, to designate identical features that are common to the figures.

4. DETAILED DESCRIPTION

Figure 1A:
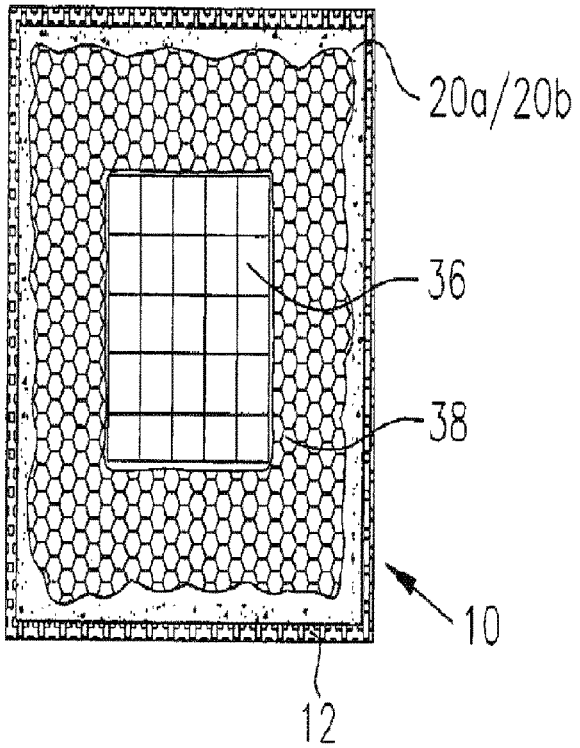
FIG. 1A PRIOR ART
FIG. 1A-FIG. 1C show a known shipping container for holding dry ice in good thermal contact with a payload.
Figure 1B:
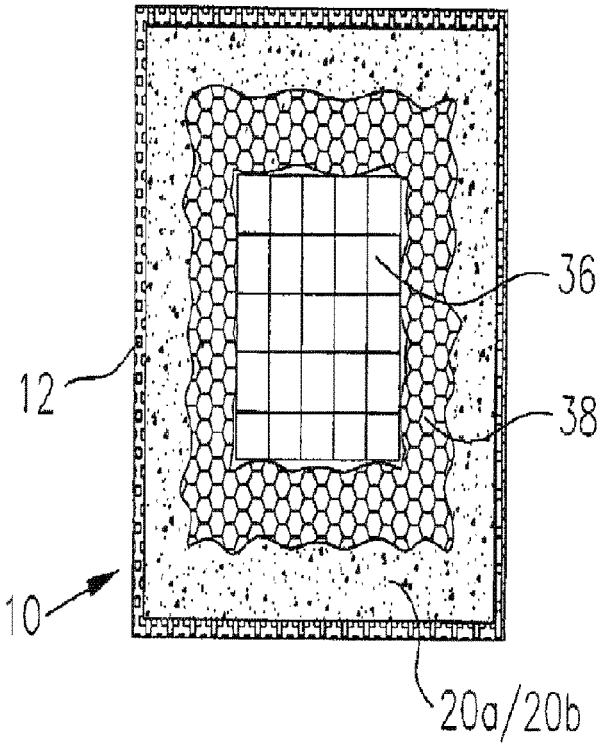
FIG. 1B PRIOR ART
Figure 1C:
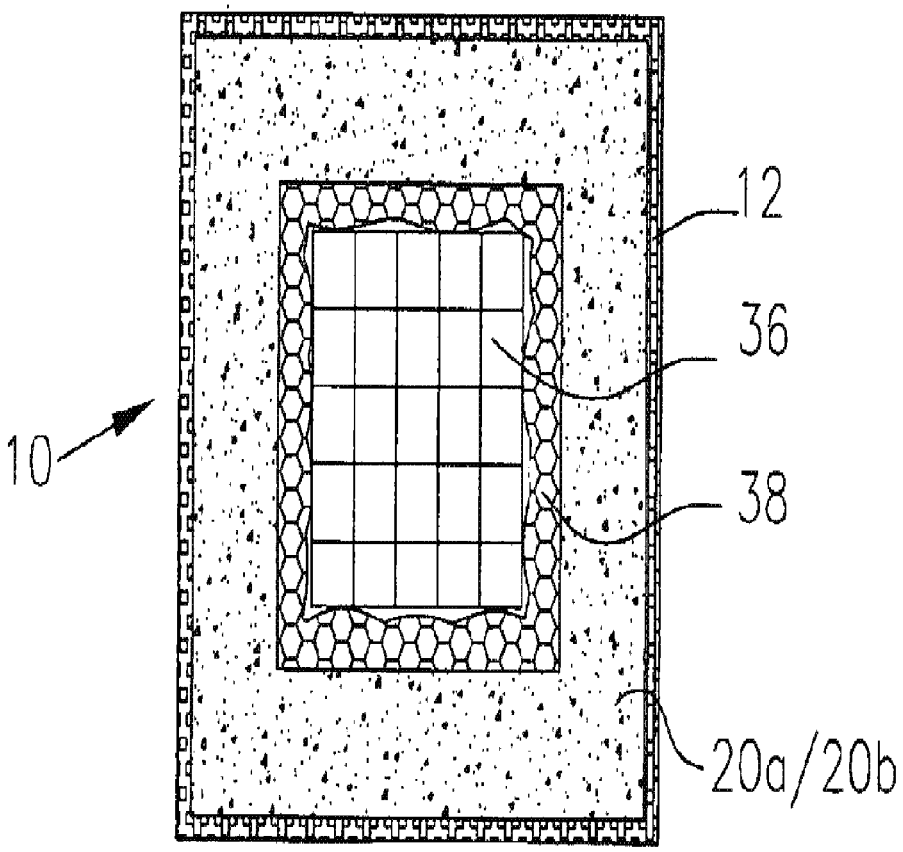
FIG. 1C PRIOR ART

The invention includes the following:

(1.) An insulated shipping container for maintaining a substantially uniform internal temperature, the insulated shipping container comprising:

(a) an outer box comprising:

a base;

four walls connected to and extending away from the base; and a lid having an open position and a closed position, wherein the base, the walls and the lid define an enclosure within the outer box when the lid is in its closed position;

(b) a plurality of insulating members disposed within the enclosure and proximate to the outer box, the plurality of insulating members comprising:

an insulating body having a first portion proximate to the base and a second portion proximate to the walls; and an insulating cover having an open position and a closed position, proximate to the lid when the lid is in its closed position, wherein the insulating body and the insulating cover define an insulated cavity when the insulating cover is in its closed position;

(c) a chamber configured to hold a payload, wherein the chamber comprises a plurality of chamber sides; and (d) a temperature control material distribution structure disposed within the insulated cavity, the temperature control material distribution structure comprising at least one partitioned tray or trough, wherein the at least one partitioned tray comprises:

a tray bottom; and a plurality of partition walls extending away from the tray bottom and defining a plurality of partition compartments.

(2.) The insulated shipping container of the above (1.), wherein the temperature control material distribution structure comprises at least one partitioned tray.

(3.) The insulated shipping container of the above (2.), wherein a first partitioned tray is disposed proximate to the insulating cover.

(4.) The insulated shipping container of the above (2.), wherein a first partitioned tray is removable.

(5.) The insulated shipping container of the above (4.), wherein the first partitioned tray comprises a handle.

(6.) The insulated shipping container of the above (2.), wherein the temperature control material distribution structure comprises a first and a second partitioned tray, the first partitioned tray being disposed below the insulating cover and the second partitioned tray being disposed proximate to the first portion of the insulating body.

(7.) The insulated shipping container of the above (2.), wherein the temperature control material distribution structure comprises a first set of stacked partitioned trays including at least two partitioned trays, disposed proximate to the first portion of the insulating body.

(8.) The insulated shipping container of the above (2.) or (7.), wherein the temperature control material distribution structure comprises a first set of stacked partitioned trays including at least two partitioned trays, disposed below the insulating cover.

(9.) The insulated shipping container of the above (1.), wherein the temperature control material distribution structure comprises at least two troughs.

(10.) The insulated shipping container of the above (9.), wherein the temperature control material distribution structure comprises (a) a first set of troughs including two troughs disposed side-by-side; and (b) a second set of troughs including two troughs disposed side-by-side;

wherein the first set of troughs being disposed proximate to the first portion of the insulating body and the second set being disposed below the insulating cover.

(11.) The insulated shipping container of the above (2.), wherein the temperature control material distribution structure further comprises at least one receptacle, the receptacle extending away from the partitioned tray and being disposed proximate to the second portion of the insulating body.

(12.) The insulated shipping container of the above (11.), wherein the at least one receptacle comprises a plurality of receptacle compartments extending along the second portion of the insulating body in a direction between the first portion of the insulating body and the insulating cover.

(13.) The insulated shipping container of the above (12.), wherein the temperature control material distribution structure comprises a first receptacle, the first receptacle comprising three receptacle compartments.

(14.) The insulated shipping container of the above (13.), wherein the first and second receptacle compartments are arranged in a nested configuration.

(15.) The insulated shipping container of the above (12.), wherein each of the plurality of receptacle compartments comprises an opening, proximate to the insulating cover.

(16.) The insulated shipping container of the above (12.), wherein the temperature control material distribution structure comprises a first receptacle and a second receptacle, the second receptacle being disposed opposite the first receptacle within the chamber.

(17.) The insulated shipping container of the above (1.), wherein each of the insulating members comprises a vacuum insulation panel.

(18.) The insulated shipping container of the above (1.), wherein the lid in its closed position is disposed opposite the base.

(19.) The insulated shipping container of any one of the above (1.)-(18.), further comprising a temperature control material.

(20.) The insulated shipping container of the above (19.), wherein the temperature control material units are sublimable.

(21.) The insulated shipping container of the above (19.), wherein the temperature control material units comprise a phase change material.

(22.) The insulated shipping container of the above (19.), further comprising a payload.

(23.) A method of packing an insulated shipping container for maintaining a payload at a substantially uniform internal temperature, the method comprising:

providing the insulated shipping container of any one of the above (1.)-(18.);

dispensing temperature control material units into the temperature control material structure;

inserting the payload into the chamber;

placing an insulating cover over the insulating body; and closing the lid of the outer box.

(24.) The method of the above (23.), wherein the temperature control material structure comprises a first partitioned tray, the method further comprising inserting the first partitioned tray after inserting the payload.

(25.) The method of the above (24.), wherein the dispensing step comprises dispensing the temperature control material units into the first partitioned tray before the first partitioned tray is inserted into the insulating body.

(26.) The method of the above (23.), wherein the dispensing step comprises reorienting the insulated shipping container.

(27.) The method of the above (23.), wherein the temperature control material units are sublimable.

(28.) The method of the above (23.), wherein the temperature control material units comprise a phase change material.

4.1 Definitions

Unless defined otherwise, all technical and scientific terms used herein have the same meaning as those commonly understood by one of ordinary skill in the art to which this invention belongs. Although methods and materials similar or equivalent to those described herein can be used in the practice or testing of the present invention, suitable methods and materials are described below. The materials, methods and examples are illustrative only, and are not intended to be limiting. All references, publications, patents, patent applications and other documents mentioned herein are incorporated by reference in their entirety. Unless clearly indicated otherwise, the following terms as used herein have the meanings indicated below.

Throughout this specification, the word "comprise" or variations such as "comprises" or "comprising" will be understood to imply the inclusion of a stated integer or groups of integers but not the exclusion of any other integer or group of integers.

The terms "include", "includes", "including", "have", "has", and "having" will be understood as open-ended and non-limiting, unless specifically stated otherwise.

The term "a" or "an" may mean more than one of an item.

The terms "and" and "or" may refer to either the conjunctive or disjunctive and mean "and/or".

The term "about" means within plus or minus 10% of a stated value. For example, "about 100" would refer to any number between 90 and 110.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense. Words such as top or bottom or above or below are to be understood in the context of a standard orientation as described below.

4.2 Shipping Containers

Figure 2:
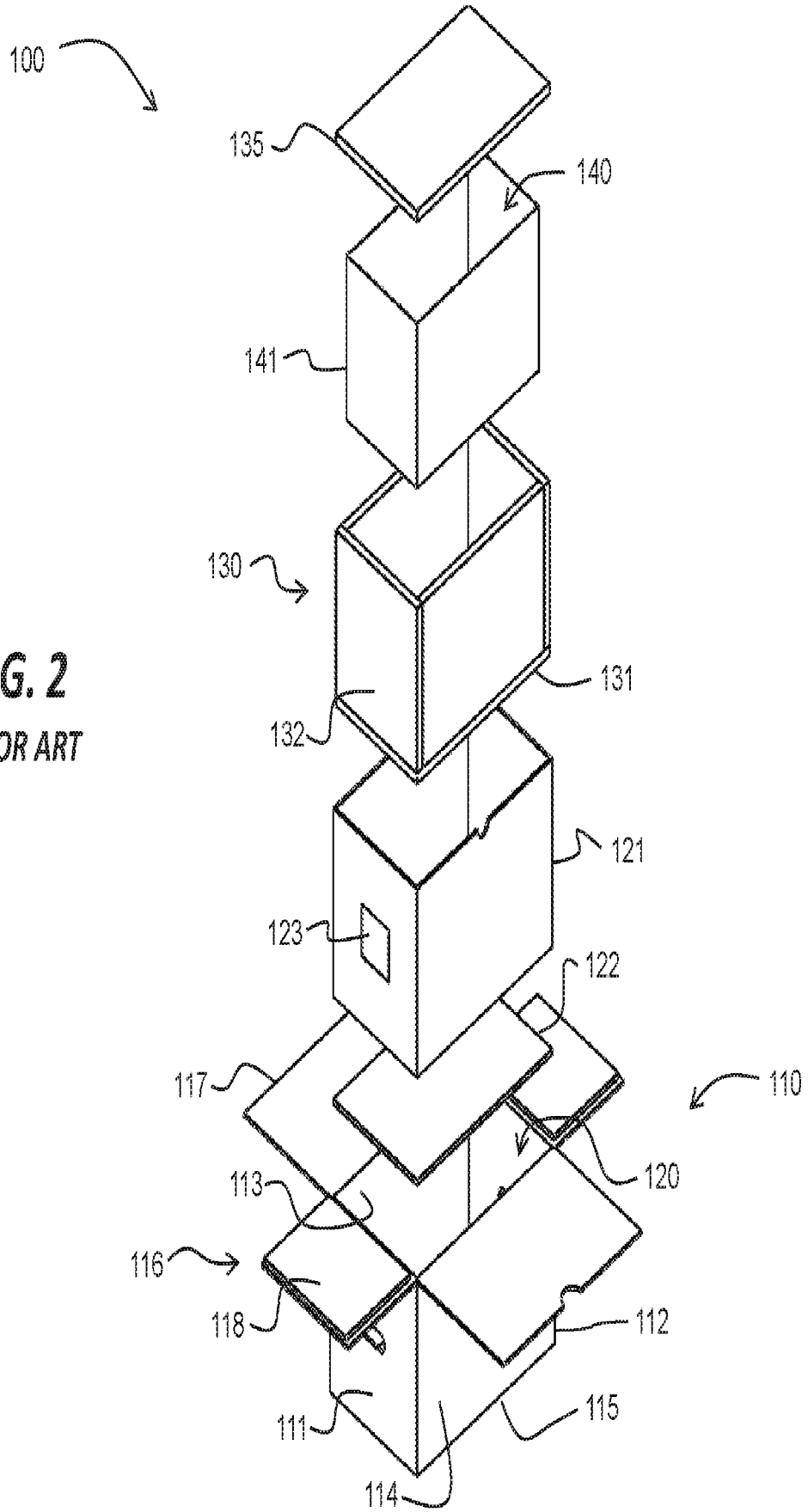
FIG. 2 PRIOR ART
FIG. 2 shows an exploded view of a known insulated shipping container.

FIG. 2 shows an exploded view of a known insulated shipping container that can be used with any of the temperature control material distribution structures of the present disclosure. Insulated shipping container 100 includes an outer box 110 having a base 115 upon which the insulated shipping container 100 sits when the insulated shipping container 100 is in its standard orientation as illustrated in FIG. 2. Outer box 110 has four walls 111, 112, 113 and 114 extending away from the base 115. Outer box 110 has a lid 116 having an open position and a closed position. Lid 116 has four hinged lid flaps 117 that extend respectively from corresponding walls 111-114. When the lid 116 is in its closed position, the base 115, the walls 111-114 and the lid 116 define an enclosure 120 within outer box 110. Opening lid 116 permits access to the enclosure 120. Outer box 110 provides structural protection for the contents and is typically made of paper, pressboard, composition board, cardboard, wood, metal, plastic or any other suitable material.

The term "box" is used herein in a generic sense and is not restricted to six-sided structures having rectangular faces. The box may be any size or shape, depending on the size and shape of the payload and the number of payloads. In one embodiment, the box is a six-sided structure having rectangular faces. In another embodiment, the box has a polyhedral shape with polygonal faces that meet along edges. Boxes according to this embodiment have a plurality of walls that are connected to the base and extend away from the base. In another embodiment, the box includes shapes such as cylinders and cones that have only a single curved wall connected to the base and extends away from the base. In another embodiment, the box has an irregular shape.

While FIG. 2 contemplates lid 116 in its closed position opposite to base 115, lid 116 may be located in other configurations. For example, boxes that are configured to be strapped to a pallet (not shown) can have a lid disposed in a wall connected to the base. Lid 116 can have hinged lid flaps 117 or it can be a separate plate, for example, one that attaches to at least one wall by mechanical fasteners, such as screws.

Referring back to FIG. 2, a plurality of insulating members are disposed within enclosure 120. The plurality of insulating members include an insulating body 130 having a first portion 131 proximate to the base 115 of outer box 110 and a second portion 132 proximate to walls 111-114. An insulating cover 135 has an open position such that it is removed from insulating body 130 and a closed position such that it is it is in contact with insulating body 130. When lid 116 of outer box 110 is in its closed position and insulating cover 135 is in its closed position, insulating cover 135 is proximate to lid 116.

Insulating body 130 and insulating cover 135 can be made of a variety of thermally insulating materials. Suitable thermal insulating materials include flexible insulating materials and rigid insulating materials. Exemplary flexible insulating materials include air containing materials such as Bubble Wrap®. Exemplary rigid insulating materials include expanded polystyrene foam, polyurethane foam, and extruded polyisocyanurate foam.

Insulating body 130 can be molded as a single piece including both first portion 131 and second portion 132 or assembled from discrete panels that are held in contact with each other as shown in FIG. 2. Vacuum insulation panels are a preferred insulating material for both the insulating body 130 and the insulating cover 135 for extended duration temperature control because of their excellent thermal insulating properties.

Vacuum insulation panels are well known in the art and comprise a core material contained within a sealed enclosure, from which air has been evacuated. The core material may be made from any open cell material, including, but not limited to, polystyrene, polyurethane, fiberglass, silica and various forms of organic foams. Suitable core materials include, but are not limited to, AEROCORE (available from American Aerogel Corporation), NANOGEL (available from Nanopore), and those disclosed in U.S. Pat. Nos. 8,436,061, 8,071,657, 7,521,485, 7,005,181, 6,344,240, 6,315,971, 6,090,439, and 5,877,100.

In some embodiments, insulating cover 135 is press-fit onto insulating body 130. In other embodiments, insulating cover 135 is held in contact with the top of second portion 132 of insulating body 130 when the lid 116 of outer box 110 is in its closed position.

As shown in FIG. 2, two of the lid flaps 117 at opposing sides of outer box 110 have an attached compressible lid flap cushion 118, which can be made of a compressible material, such as, polyethylene foam. Compressible cushion 122 is inserted into the bottom of enclosure 120. When lid 116 is closed and sealed, the lid flap cushions 118 and the bottom cushion 122 are compressed and provide pressure to force insulating cover 135 into contact with the top of second portion 132 of insulating body 130. In addition to providing cover-holding pressure, lid flap cushions 118 and bottom cushion 122 help to absorb shock if insulated shipping container 100 is dropped or collides with another object during shipping.

Further protection can be provided by an optional first inner box 121 having an optional wraparound cushion 123 disposed around the inside of the first inner box 121. Such additional protection can be advantageous not only for the payload, but also for the insulating body 130, especially if it is made of high-performance insulation, such as vacuum insulation panels. In such embodiments, the bottom cushion 122 can be disposed between the first portion 131 of insulating body 130 and base 115 of outer box 110, so that first portion 131 is proximate to base 115 but is not adjacent to base 115. Similarly, optional first inner box 121 and optional wraparound cushion 123 can be disposed between second portion 132 of insulating body 130 and walls 111-114, so that second portion 132 is proximate to walls 111-114, but is not adjacent to walls 111-114. Similarly, lid flap cushion 118 can be disposed between insulating cover 135 and the outermost part of closed lid 116.

When insulating cover 135 is closed onto insulating body 130, the insulating body 130 and the insulating cover 135 define an insulated cavity 140. A temperature control material distribution structure 150 is disposed within the insulated cavity 140. The temperature control material distribution structure is typically made of paper, pressboard, composition board, cardboard, wood, metal, plastic or any other suitable material. In one embodiment, the temperature control material distribution structure is made from cardboard.

In alternate embodiments, as shown in FIG. 2, to provide further protection, a second inner carton 141 can be disposed within insulated cavity 140. In this alternate embodiment, the temperature control material distribution structure 150 is disposed within the second inner carton 141. The second inner box protects the insulating body 130 and is typically made of paper, pressboard, composition board, cardboard, or any other suitable material.

Figure 3:
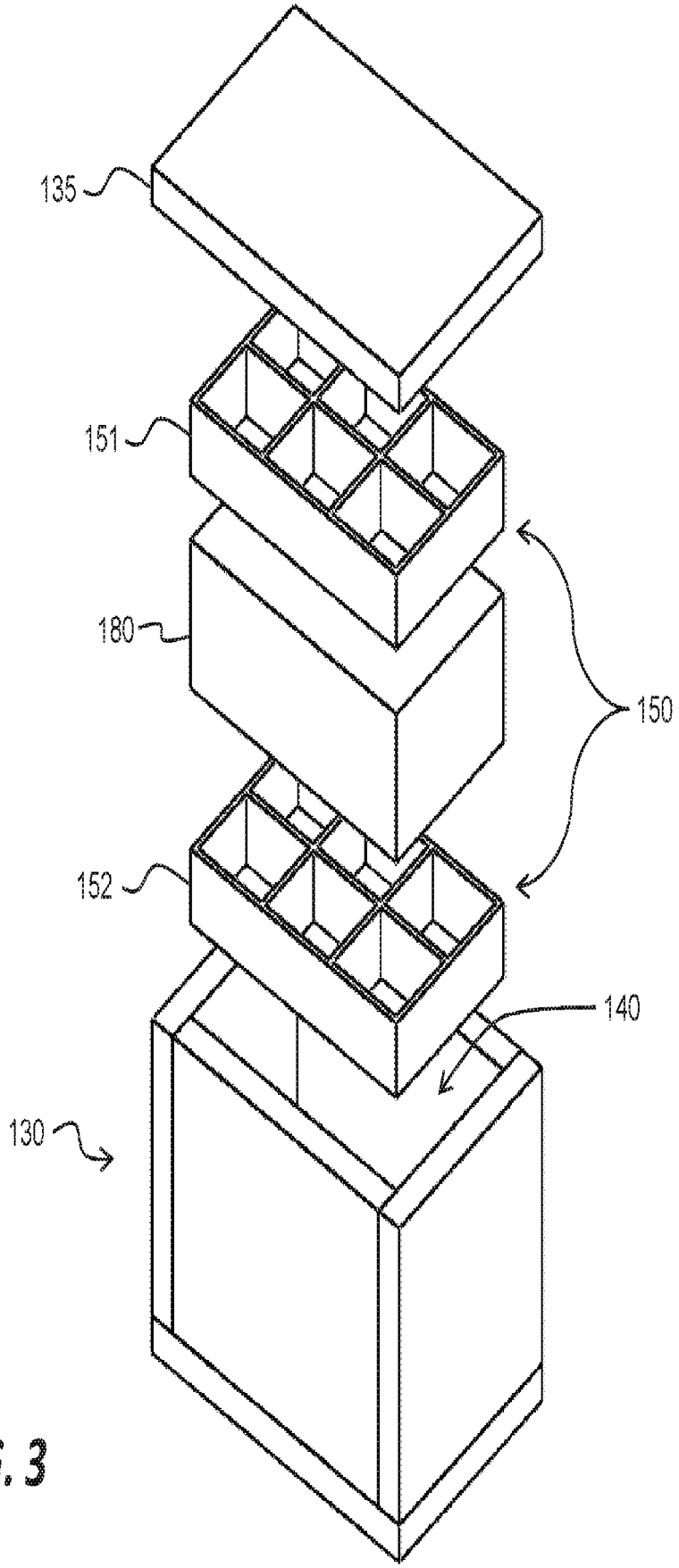
FIG. 3 shows an exploded view of an insulated body comprising a temperature control material distribution structure with two partitioned trays according to an embodiment of the present disclosure.

The temperature control material distribution structure comprises at least one component selected from a partitioned tray, a trough and a receptacle. The embodiment shown in FIG. 3 shows a temperature control material distribution structure 150 comprising a first partitioned tray 152 covering the floor of insulated body 130 and disposed below the payload box 180 and a second partitioned tray 151 covering the top of insulated body 130 and disposed above the payload box 180. The insulating cover 135 is closed onto insulating body 130.

Figure 4A:
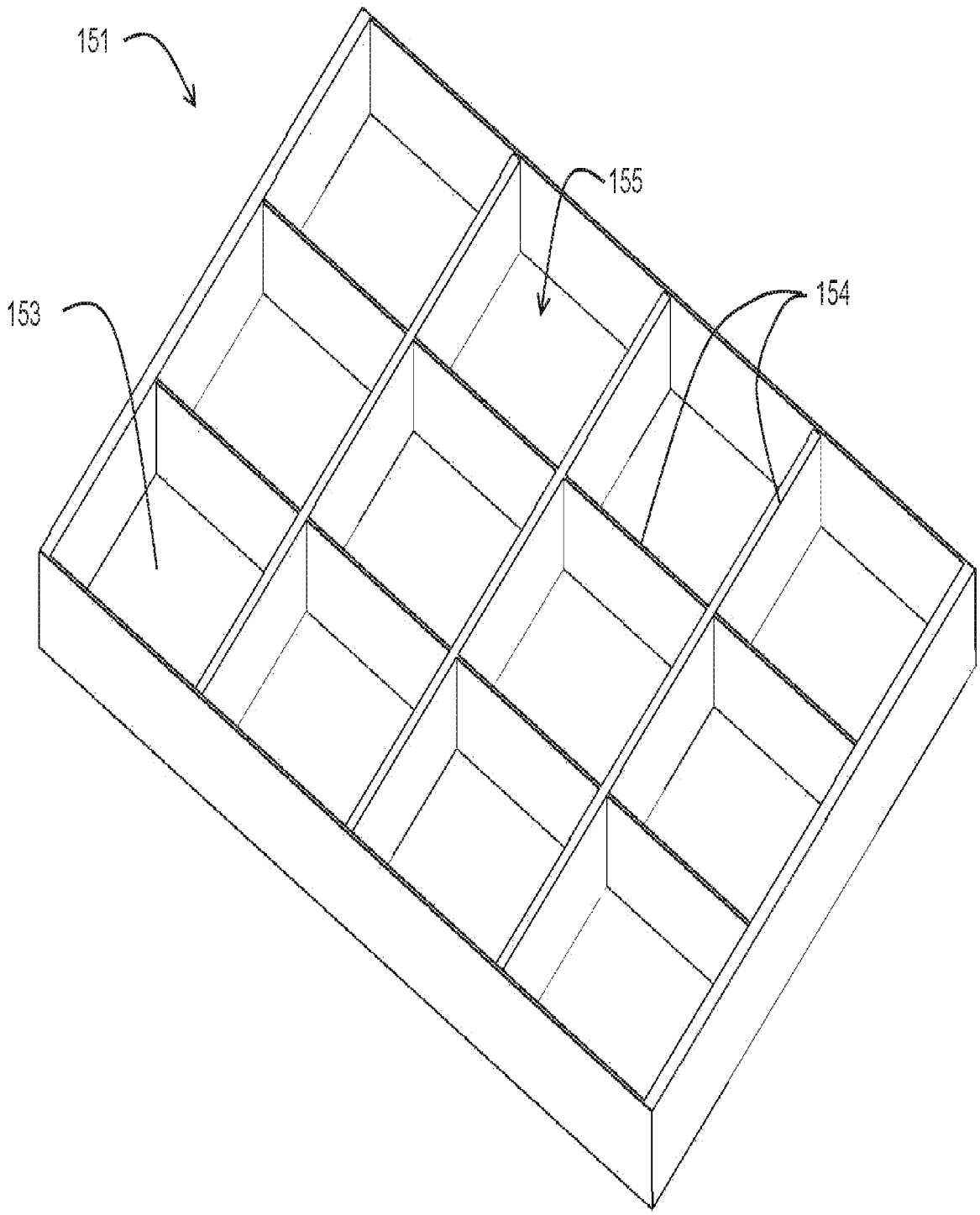
FIG. 4A shows a perspective view of a partitioned tray according to one embodiment of the present disclosure.

With reference to FIG. 4A, first partitioned tray 151 includes a tray bottom 153 integral to the first partitioned tray 151 and partition walls 154 that extend away from tray bottom 153. Tray bottom 153 and partition walls 154 together define a plurality of partition compartments 155. When disposed within the shipping container 100, tray bottom 153 is substantially parallel to base 115 of outer box 110. FIG. 4A shows partition tray 151 with twelve partition compartments 155. The number and size of compartments within the first partitioned tray 151 can vary, depending on the temperature sensitivity of the payload, the duration of shipping and the size of payload box 180.

In one embodiment, second partitioned tray 152 is identical to partition tray 151. In another embodiment, the tray bottom 153 is not integral to the second partitioned tray 152 and is provided by a separate structure, such as the bottom of inner carton 141. In another embodiment, the number and size of compartments within the second partitioned tray 152 can be the same or different from the number and size of compartments within the first partitioned tray 151.

Figure 4B:
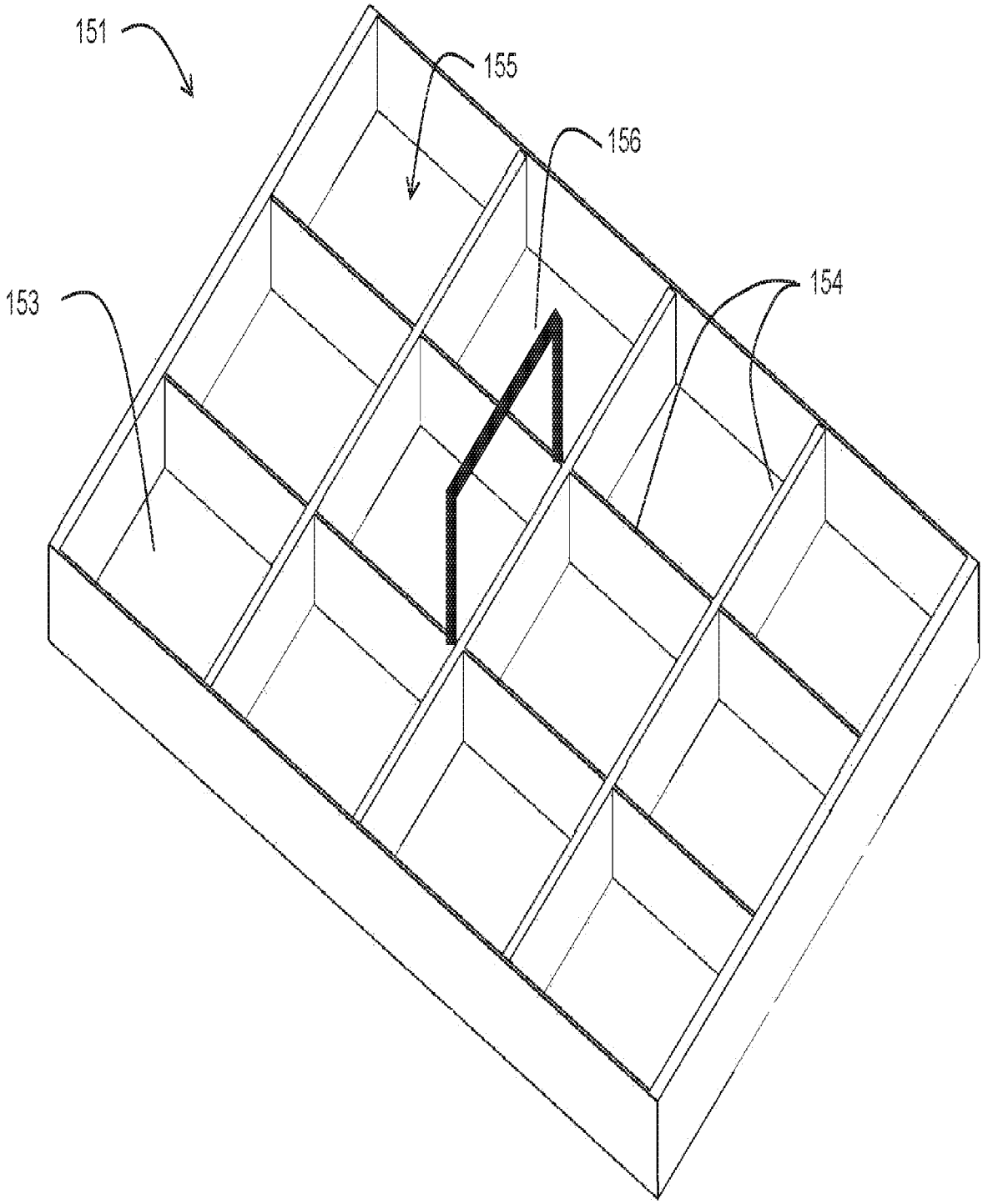
FIG. 4B shows a perspective view of partitioned tray having a handle according to another embodiment of the present disclosure.

Referring back to FIG. 3, first partitioned tray 151 is typically removable in order to insert the payload box 180, into chamber 170, while second partitioned tray 152 can be fixed in position. First partitioned tray 151 can include a handle 156 to facilitate removing and reinserting it into chamber 170 (FIG. 4B).

The payload is enclosed within a payload box 180 or is placed directly into chamber 170. Temperature control material units 190 are distributed within the partition compartments (not shown).

Temperature control material units are well known in the art and any can be used in the shipping containers of the disclosure. The selection of a particular temperature control material unit will depend on the nature and the requirements of the payload, i.e., the required temperature and temperature tolerability of the payload. For example, payloads that require low temperature and can withstand temperatures near −78.5° C. at standard atmospheric pressure, dry ice is a suitable temperature control material unit. Dry ice can be used as pellets, nuggets, chunks, blocks or other forms. Advantageously, dry ice is relatively inexpensive and leaves no residue.

For payloads that require temperature ranges, either above or below ambient temperature, one or more phase change materials preconditioned at appropriate temperatures and can be used to maintain the payload within a predetermined temperature range. A phase change material refers to a substance that absorbs and releases thermal energy while changing from one phase to another, e.g. melting and freezing. Examples of phase change materials include water, paraffin wax, ethylene glycol, propylene glycol, alkanes, fatty alcohols, fatty acids, fatty esters, eutectic mixtures and hydrated salts. The phase change material can be contained within repositories such as capsules, casings, bags, bladders, shells, hollow spheres or cylinders, vessels or vials for example.

Advantageously, the temperature control material structure 150 filled with temperature control material units 190 according to this embodiment of the disclosure provides a good thermal contact between the temperature control material units 190 and the payload box 180. Even as the temperature control material units 190 decrease in volume over time, for example, in the case of dry ice subliming, they continue to be held within the partition compartments of the partitioned tray. As a result, the payload within chamber 170 can be maintained at a substantially uniform temperature for an extended period of time.

Figure 5:
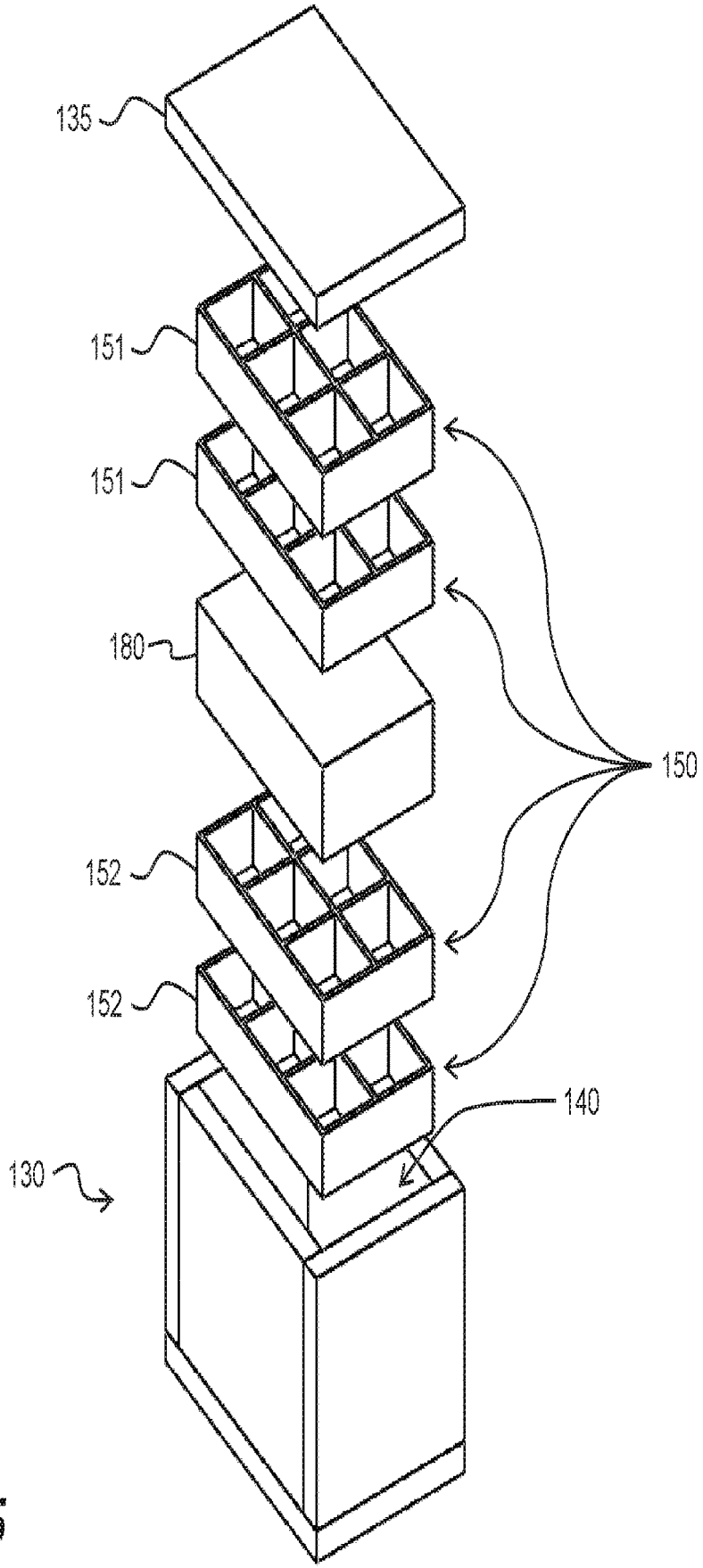
FIG. 5 shows an exploded view of an insulated body comprising a temperature distribution material structure with a first and a second stack of partitioned trays according to an embodiment of the present disclosure.

While FIG. 3 shows an embodiment in which the temperature control material distribution structure 150 includes two partitioned trays, in alternate embodiments, the temperature control material distribution structure includes a plurality of partitioned trays. In the embodiment shown in FIG. 5, the temperature control material distribution structure 150 includes a first stack of partitioned trays 152 (in which a first partitioned tray 152 is disposed above a second partitioned tray 152 in a stacked arrangement) and a second stack of partitioned trays 151 (in which a first partitioned tray 151 is disposed above a second partitioned tray 151 in a stacked arrangement). The first stack of partitioned trays 152 is disposed below the payload box 180 and the second stack of partitioned trays is disposed above the payload box 180. In one embodiment, the temperature control material distribution structure 150 includes a first stack of partitioned trays 152 and a partitioned tray 151. In another embodiment, the temperature control material distribution structure 150 includes a partitioned tray 152 and a stack of partitioned trays 151.

Figure 6A:
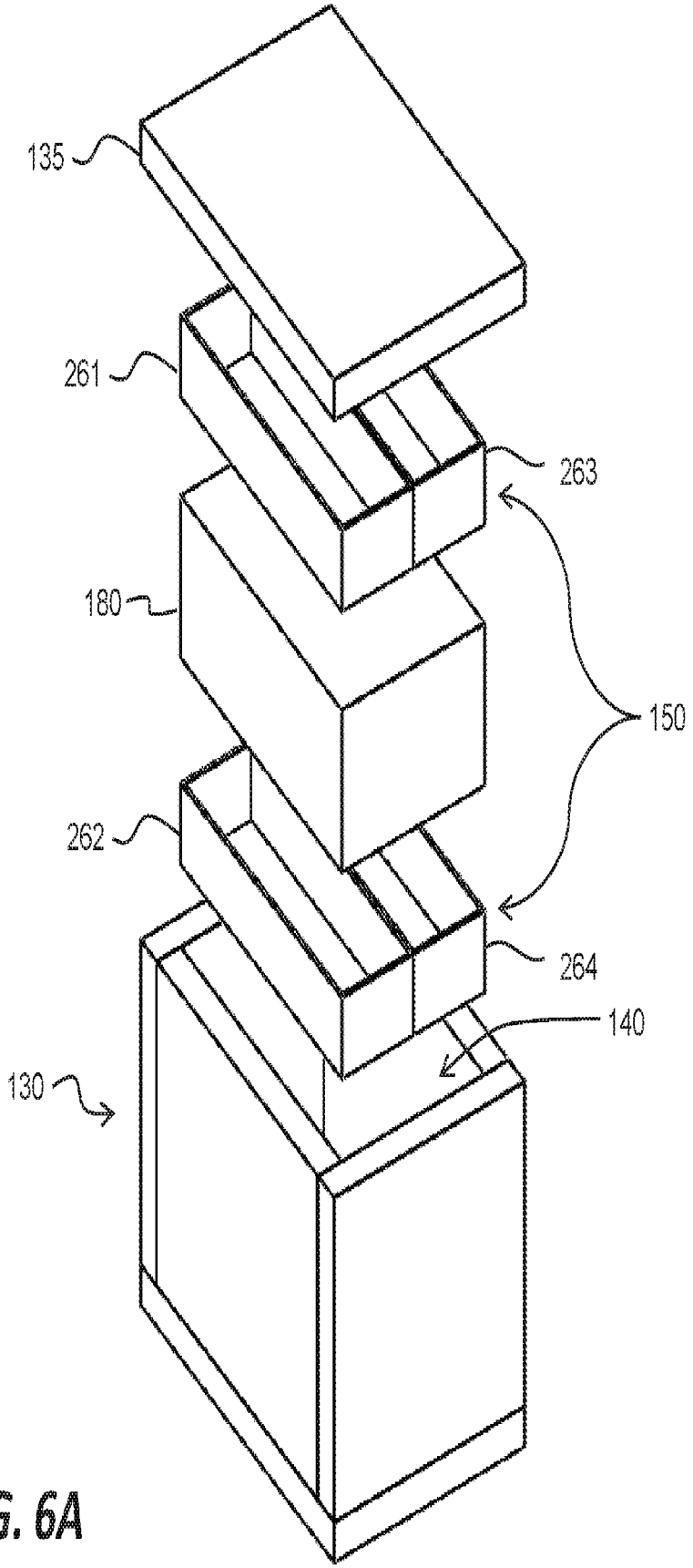
FIG. 6A shows an exploded view of an insulated body comprising a temperature control material distribution structure with a first and a second set of troughs according to an embodiment of the present disclosure.
Figure 6B:
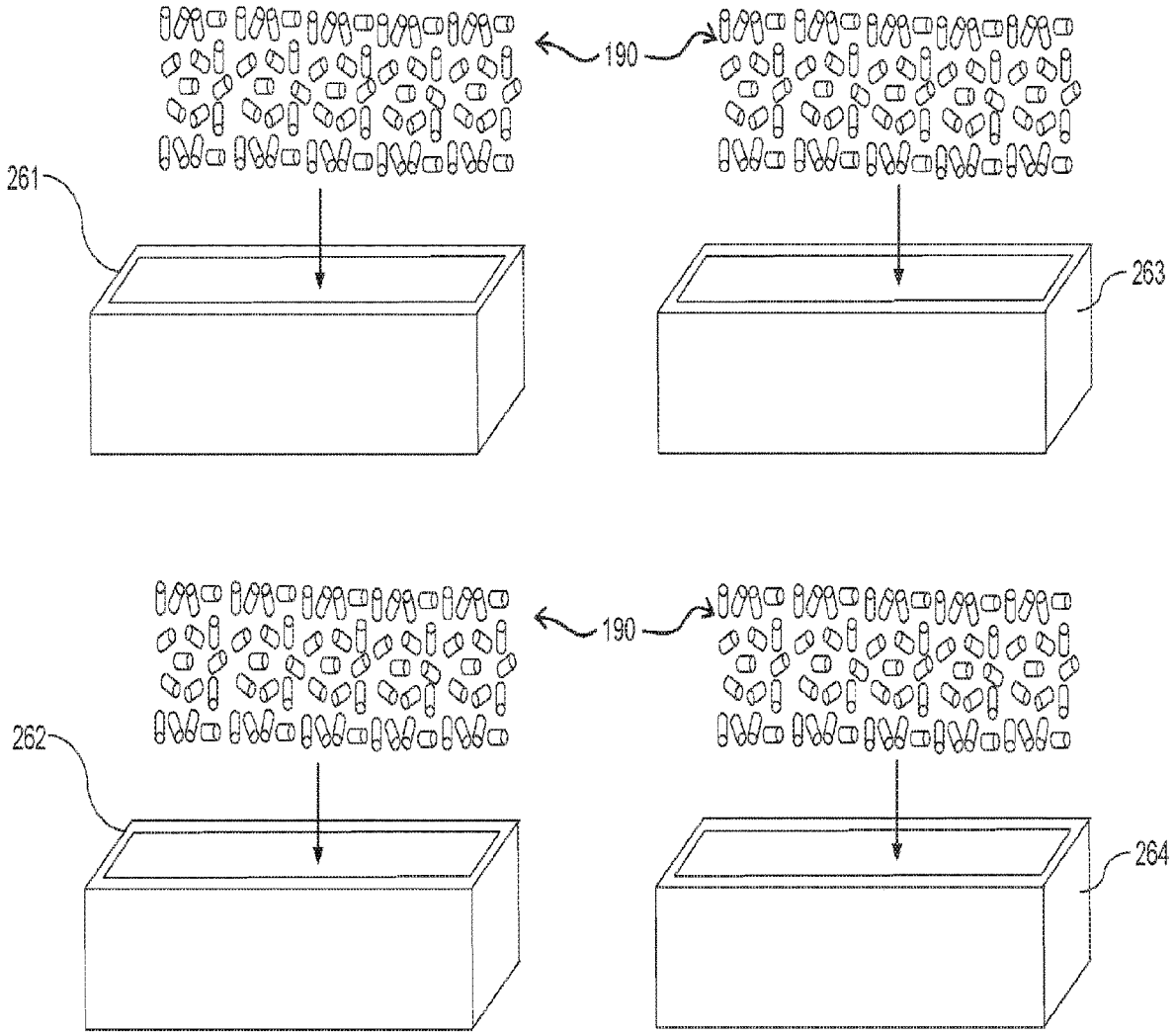
FIG. 6B shows the troughs of FIG. 6A loaded with temperature control material.

In another embodiment, the temperature control material distribution structure comprises a plurality of troughs. The embodiment shown in FIG. 6A shows an insulating body 130 comprising a temperature control material distribution structure 150 including troughs 261, 262, 263, and 264. Troughs 262 and 264 are placed in a side-by-side arrangement and can be loaded with temperature control material units 190 (FIG. 6B). In use, troughs 262 and 264 are disposed within the insulating body below the payload box 180. Troughs 261 and 263 are placed side-by-side on top of payload box 180 and are loaded with temperature control material units 190 (FIG. 6B). The insulating cover 135 is closed onto insulating body 130. While FIG. 6A shows a temperature control material distribution structure comprising two sets of troughs, with one set disposed above the payload box and the other set disposed below the payload box, the disclosure encompasses stacks of troughs (e.g., in which a first set of troughs 262 and 264 is disposed above a second set of troughs 262 and 264 in a stacked arrangement). In one embodiment, the temperature control material distribution structure comprises a first set and a second set of troughs 262 and 264 disposed below the payload box and troughs 261 and 263 disposed above. In another embodiment, the temperature control material distribution structure comprises troughs 262 and 264 disposed below the payload box and a first set and a second set of troughs 261 and 263 disposed above. In another embodiment, the temperature control material distribution structure comprises a first set and a second set of troughs 262 and 264 disposed below the payload box and a first set and a second set of troughs 261 and 263 disposed above.

Figure 7:
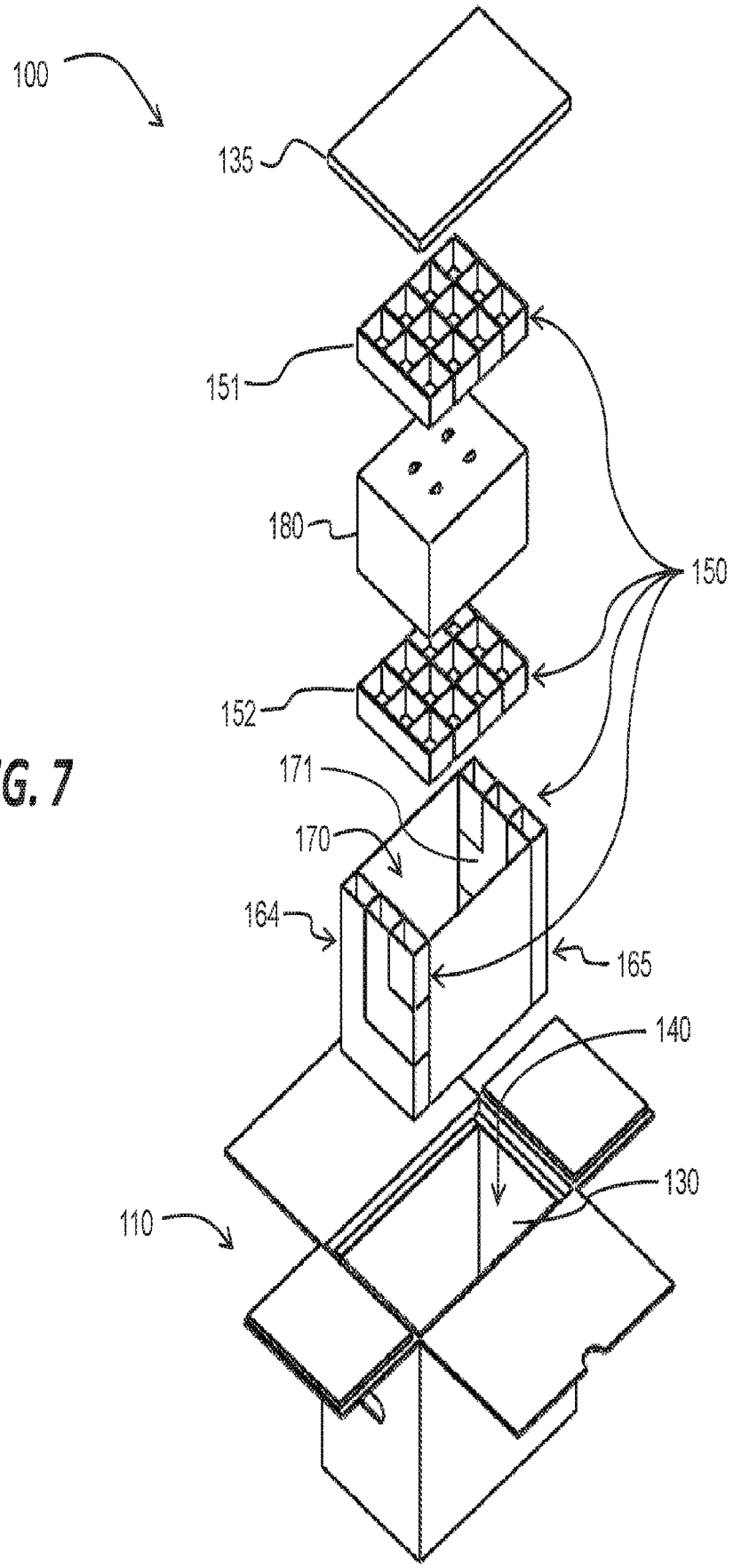
FIG. 7 shows an insulated shipping container with an exploded view of a temperature control material distribution structure according to an embodiment of the present disclosure.

In another embodiment, the temperature control material distribution structure comprises at least one partitioned tray and at least one a receptacle. The embodiment shown in FIG. 7 shows a temperature control material distribution structure 150 comprising a first partitioned tray 152 covering the floor of insulated body 130, a second partitioned tray 151 covering the top of insulated body 130, a first receptacle 164 and a second receptacle 165 covering opposing side walls of insulated body 130. A chamber 170 for holding the payload is defined within the temperature control material distribution structure 150. Chamber 170 includes four chamber walls 171. The payload is enclosed within a payload box 180 or is placed directly into chamber 170. Temperature control material units 190 are distributed within the partitioned trays and receptacles (not shown).

Advantageously, the temperature control material structure 150 filled with temperature control material units 190 at least partially surround the payload box 180, providing good thermal contact between the temperature control material units 190 and the payload box 180. An additional advantage is that the temperature control material structure 150 provides an easy to manufacture structure for holding the temperature control material 190. It also provides a mechanical structure for holding the payload box 180 in place and preventing movement of the payload in the insulated shipping container 100 during shipping. A further advantage is that, even as the temperature control material units 180 decrease in volume over time, for example, in the case of dry ice subliming, they continue to be held within their respective component (i.e., partition or receptacle). As a result, the payload within chamber 170 can be maintained at a substantially uniform temperature regardless of location within chamber 170 for an extended period of time.

Figure 8:
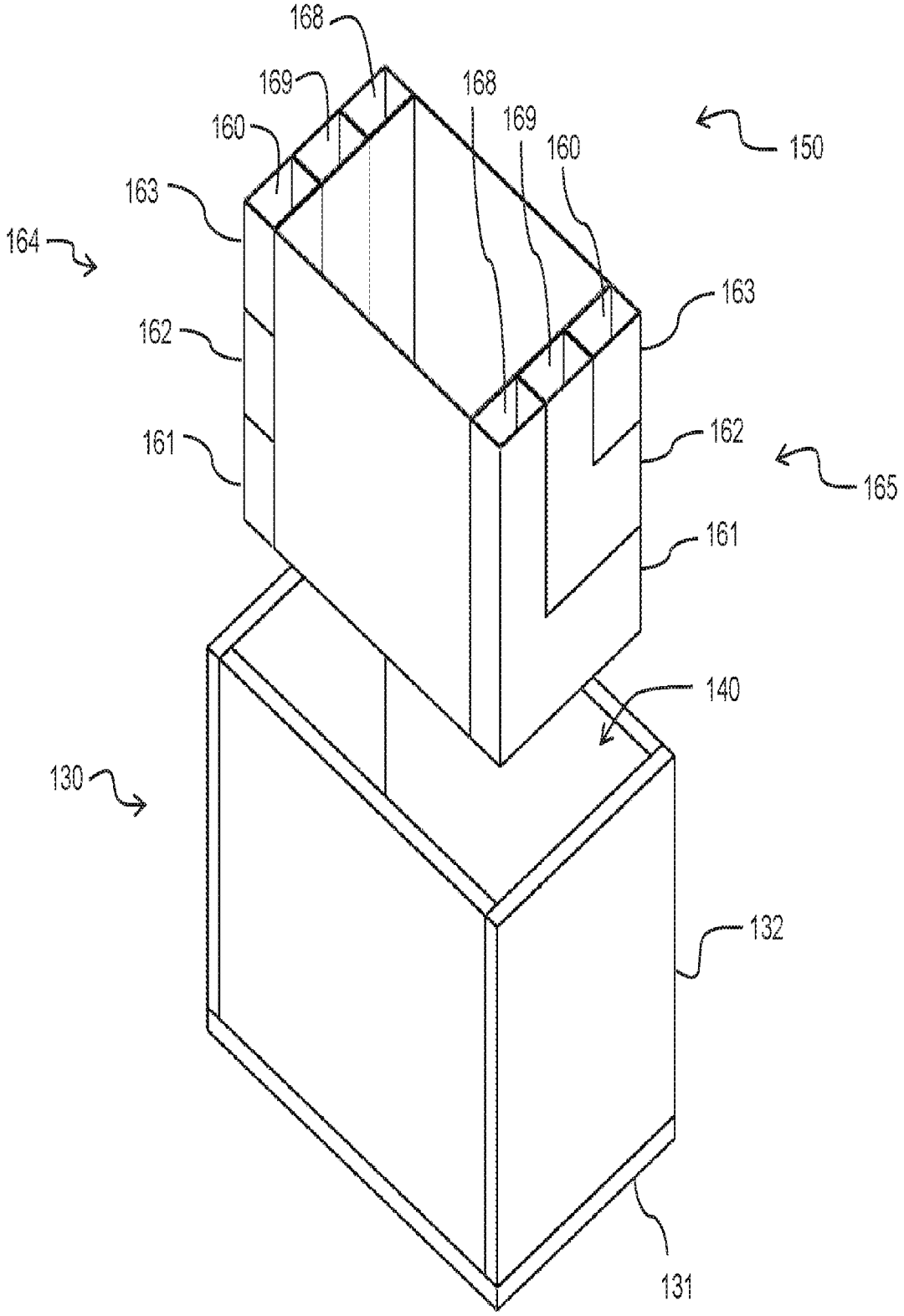
FIG. 8 shows an exploded view of an insulated body comprising a temperature control material distribution structure with a first and second receptacle, each receptacle comprising a plurality of receptacle compartments.

Referring back to FIG. 7, the temperature control material structure 150 comprises a first receptacle 164 and a second receptacle 165, the second receptacle 165 being disposed opposite the first receptacle 164 within chamber 170. Referring now to FIG. 8, first receptacle 164 and second receptacle 165, each comprises a plurality of receptacle compartments 161, 162 and 163 and extends along the second portion 132 of insulating body 130 in a direction between the first portion 131 of the insulating body 130 and the insulating cover 135. The receptacle compartments are shaped such that they can be nested. As shown in FIG. 8, receptacle compartments 161 and 162 can be L-shaped, and receptacle compartment 163 is square or rectangularly-shaped. In other embodiments, the receptacle compartments are straight vertical columns. Referring back to FIG. 8, receptacle compartment 162 is nested relative to compartment 161, and receptacle compartment 163 is nested relative to receptacle compartment 162. The plurality of receptacle compartments of receptacle 164 and receptacle 165 are similarly arranged but oppositely oriented. As shown in FIG. 8, nested L-shaped receptacle compartments 161 and 162 of receptacle 164 point in an opposing direction than the nested L-shaped receptacle compartments 161 and 162 of receptacle 165. Receptacle compartment 161 has an opening 168 proximate to the insulating cover 135 when insulating cover 135 is in its closed position. Similarly, receptacle compartments 162 and 163 have openings 169 and 160, respectively, each of which is proximate to the insulating cover 135.

The size and number of receptacle compartments will depend on the particular temperature control material unit used, the payload, the size of the shipping container and the duration of shipping.

Figure 9:
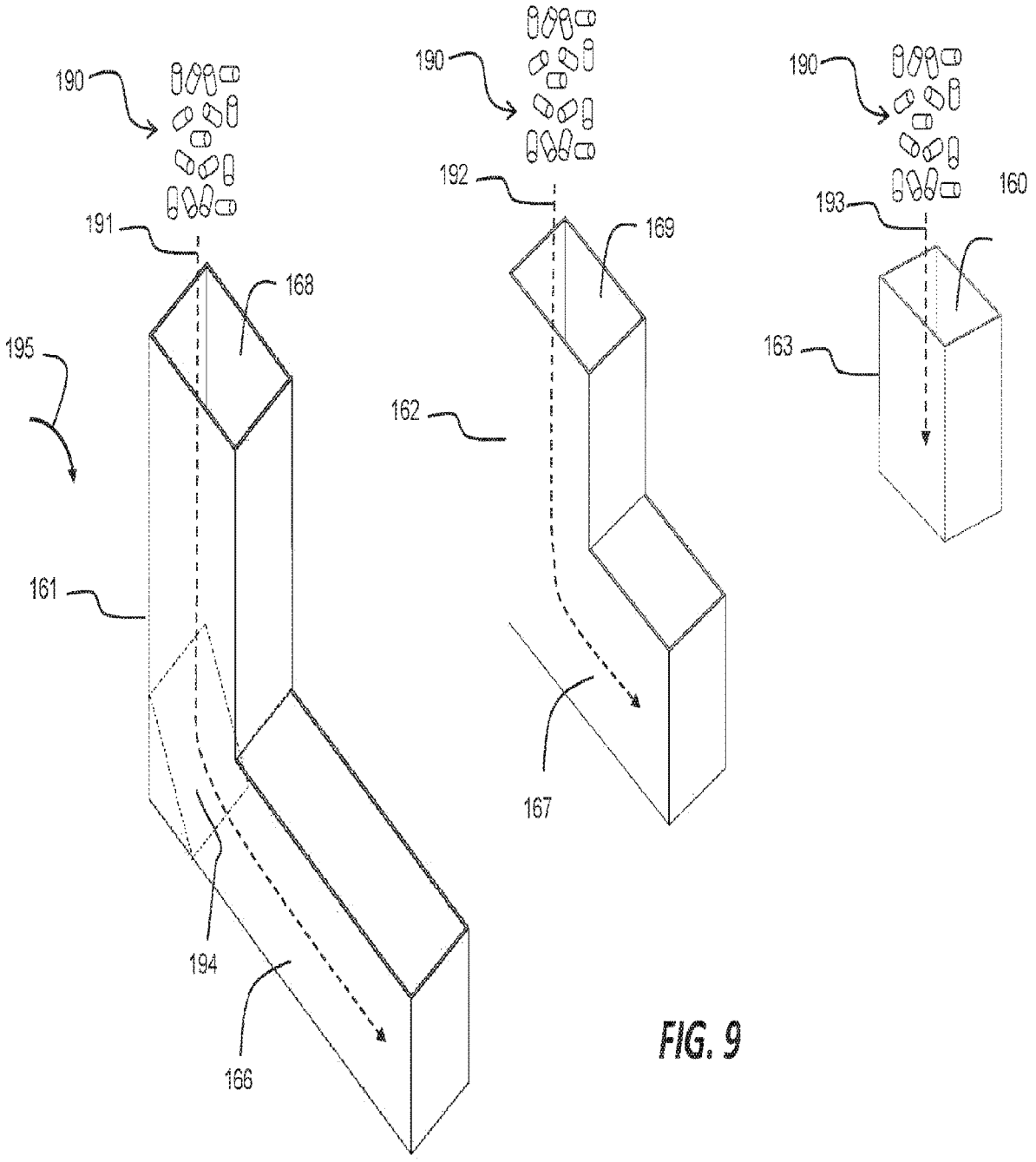
FIG. 9 shows a perspective view of a plurality of receptacle compartments loaded with temperature control material.

As shown in FIG. 9, temperature control units 190 can be loaded into receptacle compartments 161, 162 and 163 through openings 168, 169 and 160, respectively. Advantageously, the temperature control units 190 can be loaded, with the shipping container in its standard orientation. During loading, a quantity of temperature control material units 190 is loaded through opening 168 of receptacle compartment 161, proceeding along fill path 191 until it reaches the distal end of receptacle compartment 161. Optionally receptacle compartment 161 can include an internal angled corner 194 so that, as the temperature control material units 190 proceed downward, they hit internal angled corner 194 and are deflected into the distal end of receptacle compartment 161. Optionally the shipping container can be temporarily reoriented along reorientation direction 195 to facilitate distribution of the temperature control material units into receptacle compartment 161. Similarly, a quantity of temperature control material units 190 is loaded through opening 169 of receptacle compartment 162, proceeding along fill path 192 until it reaches the distal end of compartment 162. Optionally, receptacle compartment 162 can include an internal angled corner 194 (not shown) to facilitate distribution of the temperature control material units 190 into the distal end of receptacle compartment 162. Additionally, a quantity of temperature control material units 190 is loaded into opening 160 of receptacle compartment 163, proceeding along fill path 193.

Referring to FIGS. 7, 8, and 9, nested L-shaped receptacle compartments 161 and 162 allow for loading temperature control material units 190 from the top and distributing the temperature control material units 190 along a direction parallel to an adjacent chamber side 171 of chamber 170. Second partitioned tray 152 can be used to constrain the motion of temperature control material units 190 below the payload, e.g. in payload box 180. Because of second partitioned tray 152 is positioned below the payload box 180, it is loaded with temperature control material units 190 before the payload box 180 is placed into chamber 170.

Figure 10:
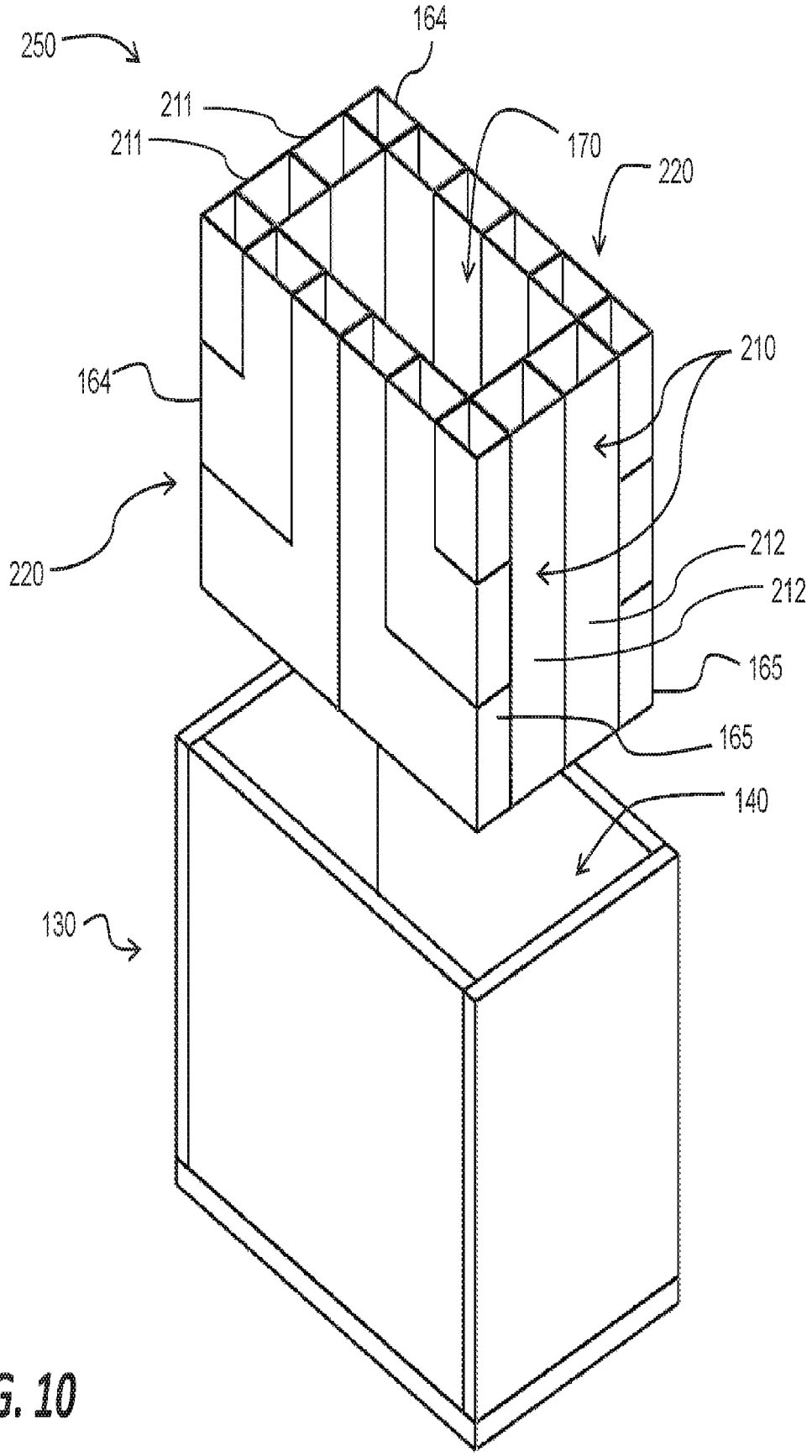
FIG. 10 shows an exploded view of an insulated body comprising a temperature control material distribution structure with a plurality of receptacles, according to an embodiment of the present disclosure.

In some shipping applications, it can be useful to fill or replenish the temperature control material units below the payload box without removing payload box. FIG. 10 shows a temperature control material distribution structure 250 for adding temperature control material units 190 below the chamber 170 without requiring the removal of the payload from chamber 170. According to this embodiment, the temperature control material distribution structure comprises a plurality of receptacles and optionally a partitioned tray, the plurality of receptacles comprising a first grouping of receptacles and a second grouping of receptacles.

Figure 11A:
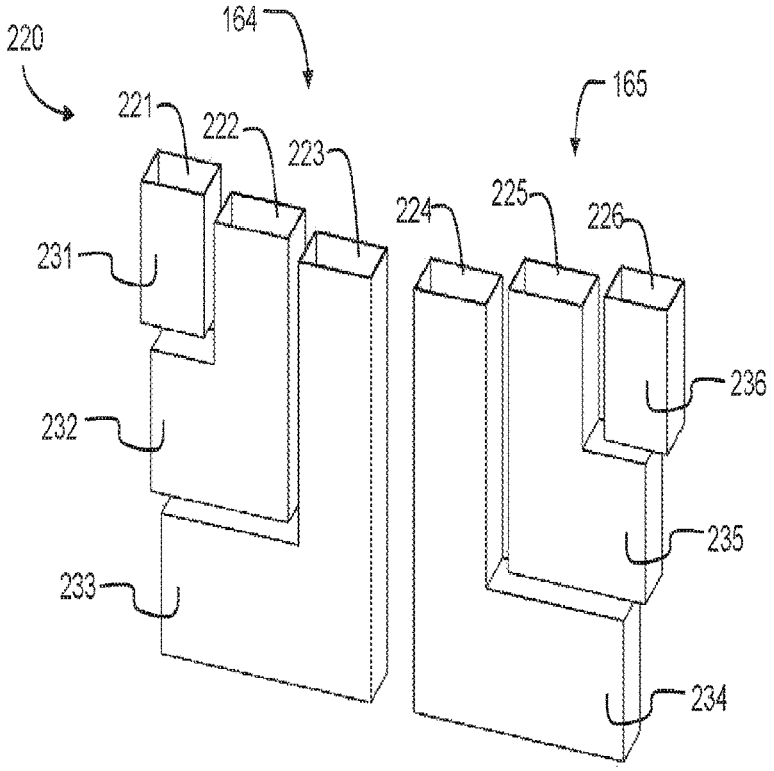
FIG. 11A shows an opposing pair of nested cluster of receptacles according to an embodiment of the disclosure.

FIG. 11A shows a first grouping 220 of receptacles 164 and 165 arranged as a nested cluster of receptacle compartments. Receptacle 164 includes receptacle compartment 231 having an opening 221, L-shaped receptacle compartment 232 having an opening 222, and L-shaped receptacle compartment 233 having an opening 223. Receptacle 165 includes L-shaped receptacle compartment 234 having an opening 224, L-shaped receptacle compartment 235 having an opening 225, and receptacle compartment 236 having an opening 226. It will be understood that a plurality of first grouping of receptacles can be used and disposed in opposing manner. While FIG. 11A shows one configuration of receptacles 164 and 165, different configurations of 164 and 165 are encompassed by the present disclosure.

In some embodiments, one or more of the receptacle compartment(s) include an internal angled corner (not shown) so that, as the temperature control material units 190 proceed downward, they hit the internal angled corner and are deflected into the distal end of receptacle compartment (s).

Figure 11B:
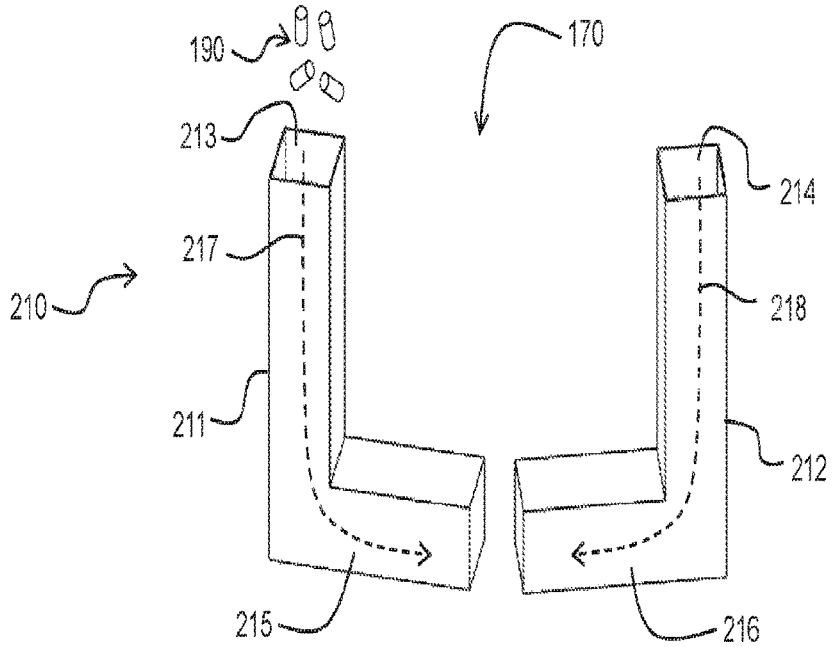
FIG. 11B shows a side perspective view of an opposing pair of receptacles according to an embodiment of the disclosure.

FIG. 11B shows a second grouping 210 of receptacles arranged as an opposing pair of L-shaped receptacles 211 and 212. L-shaped receptacle 211 has an opening 213 at the top and a section 215 disposed below chamber 170. When temperature control material units 190 are loaded through opening 213 they travel along flow path 217 into section 215 below chamber 170. Similarly, L-shaped receptacle 212 has an opening 214 at the top and a section 216 disposed below chamber 170. When temperature control material units 190 are loaded through opening 214 they travel along flow path 218 into section 216 below chamber 170. It will be understood that a plurality of first grouping of receptacles can be used and disposed in a side-by-side manner.

In some embodiments, one or more of the L-shaped receptacle(s) include an internal angled corner (not shown) so that, as the temperature control material units 190 proceed downward, they hit the internal angled corner and are deflected into the distal end of the L-shaped receptacle(s).

Referring back to FIG. 10, the temperature control material distribution structure 250 has a pair of a first grouping of receptacles 210, arranged in a side-by-side manner and a pair of a second grouping of receptacles 220, arranged in an opposing manner. The pair of a first grouping of receptacles 210 is disposed proximate to the pair of a second grouping of receptacles, with their respective openings 213, 214, and 221-226 disposed above chamber 170 and sections 215 and 216 of the first grouping of receptacles disposed below chamber 170.

Selection of a particular temperature control material distribution structure (e.g., troughs or partitioned trays) will depend on the particular temperature control material unit used, the payload, the size of the shipping container and the duration of shipping. For example, in some applications in which dry ice is the temperature control material, partitioned trays would provide an advantage of constraining the dry ice in two directions. In applications in which the shipper is small and the partitioned trays is too small to allow filling with dry ice, troughs would be useful. Also, for modularity, one trough size could be used in larger shippers by placing more side by side.

4.3 Methods

The present disclosure also provides methods of packing an insulated shipping container. The method comprises providing a shipping container as described herein; dispensing temperature control material units into the temperature control material structure; inserting the payload into the chamber; placing an insulating cover over the insulating body; and closing the lid of the outer box.

In one embodiment, the dispensing of temperature control material units step comprises dispensing the temperature control material units into the top partitioned tray before the top partitioned tray is inserted into the insulating body. In another embodiment, the dispensing step comprises reorienting the shipping container.

The present disclosure also provides methods of insulating a payload. The method comprises providing a shipping container as described herein; and placing a payload within the shipper box. The shipping container insulates the payload.

In order that this invention be more fully understood, the following examples are set forth. These examples are for the purpose of illustration only and are not to be construed as limiting the scope of the invention in any way.

5. EXAMPLES

Compartmentalized 59L shipping containers have been made and tested with pellets of dry ice. Thermocouples were placed at the top corner, center, and opposite bottom corner of the payload space. The shipping containers were tested four times with each instance placing the shipper in a different orientation for the duration of the test.

The result showed that the shipper met the acceptance criteria for duration in each tested orientation. The temperature gradient between each thermocouple probe was also reduced as compared to a shipping container loaded with dry ice in a typical manner (not compartmentalized, above and below the payload only), especially when placed in a non-standard orientation.

The invention has been described in detail with particular reference to certain preferred embodiments thereof, but it will be understood that variations and modifications can be effected within the spirit and scope of the invention. For example, although the above embodiments are described in the context of a shipping container, they are also applicable to storage containers that are configured to maintain a substantially uniform internal temperature for an extended period of time without being shipped. For a storage container it can be especially advantageous to be able to replenish the temperature control material units as described above without disturbing the contents of the storage container during prolonged constant temperature storage. The description and examples should not be construed as limiting the scope of the disclosure.

What is claimed is:

1. An insulated shipping container for maintaining a substantially uniform internal temperature, the insulated shipping container comprising:

(a) an outer box comprising:

a base;

four walls connected to and extending away from the base; and a lid having an open position and a closed position, wherein the base, the walls and the lid define an enclosure within the outer box when the lid is in its closed position;

(b) an insulating body disposed within the enclosure, defining an insulated cavity and having an insulating bottom, a plurality of insulating side walls and an insulating cover having an open position and a closed position, proximate to the lid when the lid is in its closed position;

(c) a temperature control material distribution structure disposed within the insulated cavity, the temperature control material distribution structure comprising a first partitioned tray or trough, extending along the insulated body and having an open top, and a second partitioned tray or trough, disposed proximate to the insulating cover and having an open top, wherein the partitioned tray comprises:

a tray bottom; and a plurality of partition walls extending away from the tray bottom and defining a plurality of partition compartments;

(d) a chamber defined by the temperature control material distribution structure and the insulating body, the chamber having a plurality of chamber walls and configured to hold a payload box; and (e) the payload box configured to hold a payload, wherein the payload box includes a payload box top, a payload box bottom and a plurality of payload box sidewalls extending from the payload box bottom, the payload box sized to be retained within the insulated cavity, wherein the first partitioned tray or trough is disposed between the payload box bottom and the insulating bottom and the second partitioned tray or trough is disposed between the insulating cover and the payload box top.

2. The insulated shipping container of claim 1, wherein the temperature control material distribution structure comprises the first and the second partitioned trays.

3. The insulated shipping container of claim 2, wherein the temperature control material distribution structure comprises a first set of stacked partitioned trays including at least two partitioned trays, disposed proximate to the insulating bottom.

4. The insulated shipping container of claim 2, wherein the temperature control material distribution structure comprises a first set of stacked partitioned trays including at least two partitioned trays, disposed below the insulating cover.

5. The insulated shipping container of claim 2, wherein the temperature control material distribution structure further comprises at least one receptacle, the receptacle extending away from the partitioned tray and being disposed proximate to the insulating side walls.

6. The insulated shipping container of claim 5, wherein the at least one receptacle comprises a plurality of receptacle compartments extending along the insulating side walls.

7. The insulated shipping container of claim 6, wherein the temperature control material distribution structure comprises a first receptacle, the first receptacle comprising three receptacle compartments.

8. The insulated shipping container of claim 7, wherein the first and second receptacle compartments are arranged in a nested configuration.

9. The insulated shipping container of claim 6, wherein each of the plurality of receptacle compartments comprises an opening, proximate to the insulating cover.

10. The insulated shipping container of claim 6, wherein the temperature control material distribution structure comprises a first receptacle and a second receptacle, the second receptacle being disposed opposite the first receptacle within the insulated cavity.

11. The insulated shipping container of claim 1, wherein the temperature control material distribution structure comprises at least two troughs.

12. The insulated shipping container of claim 11, wherein the temperature control material distribution structure comprises (a) a first set of troughs including two troughs disposed side-by-side; and (b) a second set of troughs including two troughs disposed side-by-side;

wherein the first set of troughs being disposed proximate to the insulating bottom and the second set being disposed below the insulating cover.

13. The insulated shipping container of claim 1, wherein each of the insulating members comprises a vacuum insulation panel.

14. The insulated shipping container of claim 1, wherein the lid in its closed position is disposed opposite the base.

15. The insulated shipping container of claim 1, further comprising a temperature control material.

16. An insulated shipping container for maintaining a substantially uniform internal temperature, the insulated shipping container comprising:

(a) an outer box comprising:

a base;

four walls connected to and extending away from the base; and a lid having an open position and a closed position, wherein the base, the walls and the lid define an enclosure within the outer box when the lid is in its closed position;

(b) an insulating body disposed within the enclosure, defining an insulated cavity and having an insulating bottom and a plurality of insulating side walls;

(c) a temperature control material distribution structure disposed within the insulated cavity, the temperature control material distribution structure comprising:

(i) at least one partitioned tray, the at least one partitioned tray comprising:

a tray bottom; and a plurality of partition walls extending away from the tray bottom and defining a plurality of partition compartments;

(ii) at least one receptacle, the at least one receptacle having an open top proximate to the lid and a distal end proximate to the insulating bottom, the at least one receptacle extending along at least one of the plurality of insulating sidewalls and along the insulating bottom; and (d) a payload box configured to hold a payload, wherein the payload box includes a payload box top, a payload box bottom and a plurality of payload box sidewalls extending from the payload box bottom, the payload box sized to be retained within the insulated cavity, wherein the at least one partitioned tray is disposed between the payload box bottom and the insulating bottom and the at least one receptacle is disposed between the at least one of the plurality of payload box sidewalls and the at least one of the plurality of insulating side walls.

17. The insulated shipping container of claim 16, wherein a first partitioned tray is disposed proximate to the insulating cover.

18. The insulated shipping container of claim 16, wherein the temperature control material distribution structure comprises a first and a second partitioned tray, the first partitioned tray being disposed below the insulating cover and the second partitioned tray being disposed proximate to the insulating bottom.

19. The insulated shipping container of claim 16, wherein the temperature control material distribution structure further comprises at least one trough.

20. A method comprising:

(a) dispensing a plurality of temperature control material units into a first partitioned tray or trough having an open top, within an insulated cavity, the insulated cavity defined by an insulating body within an outer box, the insulating body having an insulating bottom and a plurality of insulating sidewalls extending from the insulating bottom;

(b) inserting a payload into the insulated cavity;

(c) disposing a second partitioned tray or trough having an open top on top of the payload; and (d) dispensing a plurality of temperature control material units into the second partitioned tray or trough.

21. A method comprising:

(a) disposing a payload within an insulated cavity, the insulated cavity defined by an insulating body within an outer box, the insulating body having an insulated bottom and a plurality of insulating sidewalls extending from the insulating bottom;

(b) after disposing the payload within the insulated cavity, dispensing a plurality of temperature control units into a temperature control material distribution structure disposed within the insulated cavity, wherein the temperature control material distribution comprises:

(i) at least one partitioned tray or trough, the at least one partitioned tray comprising:

a tray bottom; and a plurality of partition walls extending away from the tray bottom and defining a plurality of partition compartments; and (ii) at least one receptacle, the at least one receptacle having an open top and extending along one of the plurality of insulating sidewalls.

22. The method of claim 21, wherein the temperature control material distribution structure comprises a first and a second partitioned trays or troughs, the method further comprising: disposing the first partitioned tray after inserting the payload.

23. The method of claim 22, further comprising, before dispensing the payload within the insulated cavity, disposing the second partitioned tray or trough within the insulated cavity and dispensing the plurality of temperature control units therein.

* * * * *